US011739930B1

(12) United States Patent
Sung et al.

(10) Patent No.: US 11,739,930 B1
(45) Date of Patent: Aug. 29, 2023

(54) LIGHT-EMITTING FAN

(71) Applicant: COOLER MASTER CO., LTD., Taipei (TW)

(72) Inventors: Chia-Hao Sung, Taipei (TW); Wen-Hong Chen, Taipei (TW); Wan-Ting Shi, Taipei (TW)

(73) Assignee: COOLER MASTER CO., LTD., Taipei (TW)

( * ) Notice: Subject to any disclaimer, the term of this patent is extended or adjusted under 35 U.S.C. 154(b) by 0 days.

(21) Appl. No.: 17/835,871

(22) Filed: Jun. 8, 2022

(30) Foreign Application Priority Data

Apr. 22, 2022 (TW) ..... 111204138

(51) Int. Cl.

| | |
|---|---|
| ***F21V 33/00*** | (2006.01) |
| ***F04D 29/66*** | (2006.01) |
| ***F04D 29/32*** | (2006.01) |
| ***F04D 19/00*** | (2006.01) |

(52) U.S. Cl.
CPC ..... *F21V 33/0096* (2013.01); *F04D 19/002* (2013.01); *F04D 29/325* (2013.01); *F04D 29/663* (2013.01)

(58) Field of Classification Search
CPC .. F21V 33/0096; F04D 19/002; F04D 29/325; F04D 29/663
See application file for complete search history.

(56) References Cited

U.S. PATENT DOCUMENTS

2020/0063956 A1* 2/2020 Horng ..... F04D 29/005
2022/0057080 A1* 2/2022 Xu ..... F21V 33/0096

* cited by examiner

*Primary Examiner* — Grant Moubry
*Assistant Examiner* — Ruben Picon-Feliciano
(74) *Attorney, Agent, or Firm* — Maschoff Brennan

(57) ABSTRACT

A light-emitting fan includes a fan frame, a light-permeable impeller mounted on the fan frame, a first and a second light source assembly. The light-permeable impeller includes a hub and blades. The hub includes a top plate and an annular side plate. The annular side plate is connected to the top plate, the top plate and the annular side plate together form an accommodation space. The annular side plate has an annular side surface facing away from the accommodation space and an inclined incident surface facing away from the annular side surface and non-parallel to the annular side surface. The blades are connected to the annular side surface. The first light source assembly is located in the accommodation space and configured to emit light to the top plate. The second light source assembly is located in the accommodation space and configured to emit light to the inclined incident surface.

11 Claims, 6 Drawing Sheets

LIGHT-EMITTING FAN

CROSS-REFERENCE TO RELATED APPLICATIONS

This non-provisional application claims priority under 35 U.S.C. § 119(a) on Patent Application No(s). 111204138 filed in Taiwan, R.O.C. on Apr. 22, 2022, the entire contents of which are hereby incorporated by reference.

TECHNICAL FIELD

The disclosure relates to a fan, more particularly to a light-emitting fan.

BACKGROUND

As technology progresses, a widely used personal computer is no longer just a business instrument. When the personal computer is cooperated with a variety of peripheral devices and audio and video output devices with high resolution, the personal computer may also function as a multimedia and entertainment equipment.

At present, a casing or chassis of the personal computer may be made of transparent material (such as acrylic), or may have a hollow structure, and multi-color LED bars or full-color LED beads are used in the personal computer, providing the personal computer a rich and colorful appearance.

One way to provide the personal computer a rich and colorful appearance is to install the multi-color LED bars or full-color LED beads on a fan of the personal computer. However, manufacturers still encounter a bottleneck of luminous quality of a light-emitting fan in design. Therefore, how to further improve the luminous quality of the light-emitting fan is one of the crucial topics in this field.

SUMMARY

The disclosure provides a light-emitting fan which is capable of having an improved luminous quality.

One embodiment of the disclosure provides a light-emitting fan. The light-emitting fan includes a fan frame, a light-permeable impeller, a first light source assembly, and a second light source assembly. The light-permeable impeller is rotatably mounted on the fan frame. The light-permeable impeller includes a hub and a plurality of blades. The hub includes a top plate and an annular side plate. The annular side plate is connected to a periphery of the top plate, the top plate and the annular side plate together form an accommodation space. The annular side plate has an annular side surface and an inclined incident surface, the annular side surface faces away from the accommodation space, the inclined incident surface faces away from the annular side surface and is non-parallel to the annular side surface. The blades are connected to the annular side surface of the hub. The first light source assembly is located in the accommodation space and configured to emit light to the top plate. The second light source assembly is located in the accommodation space and configured to emit light to the inclined incident surface.

According to the light-emitting fans as discussed in the above embodiment, since the light-emitting fan is equipped with the first light source assembly and the second light source assembly, the first light source assembly can uniformly illuminate the hub of the light-permeable impeller, and the second light source assembly can uniformly illuminate the blades of the light-permeable impeller, such that the luminous quality of the light-emitting fan is increased. In addition, the light-emitting frequencies of the first light source assembly and the second light source assembly may be determined according to the rotation frequency of the light-emitting fan so as to achieve a special visual effect via persistence of vision.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
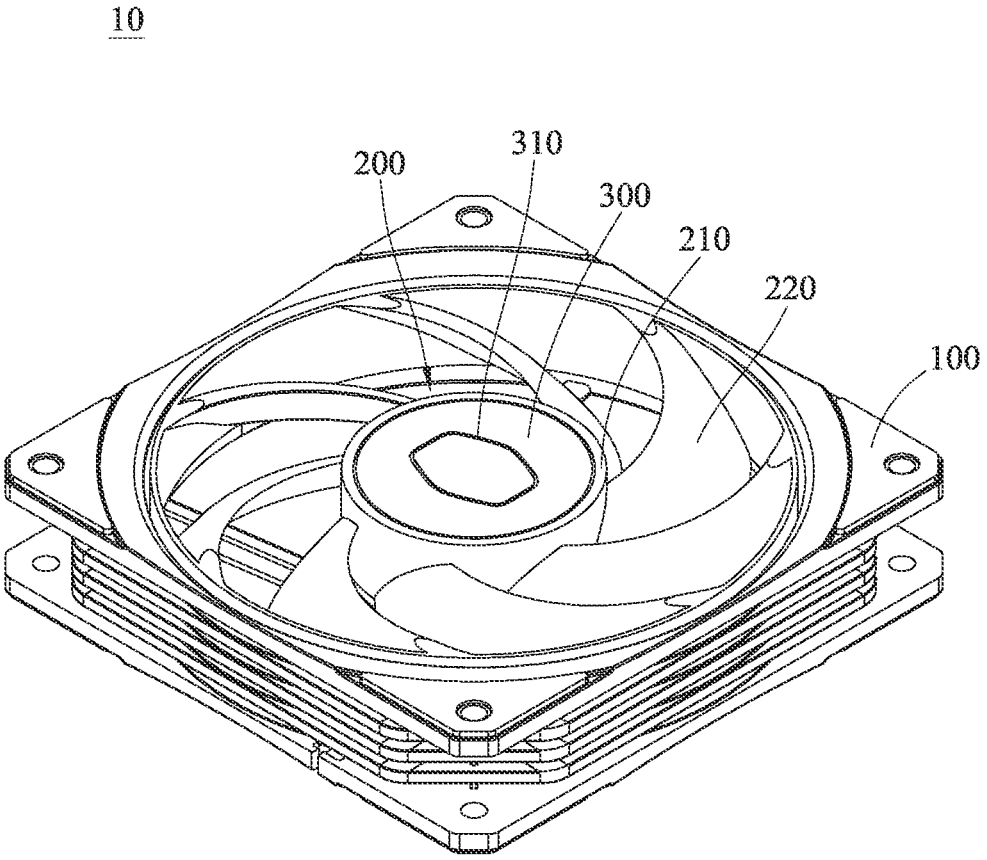
FIG. 1 is a perspective view of a light-emitting fan according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
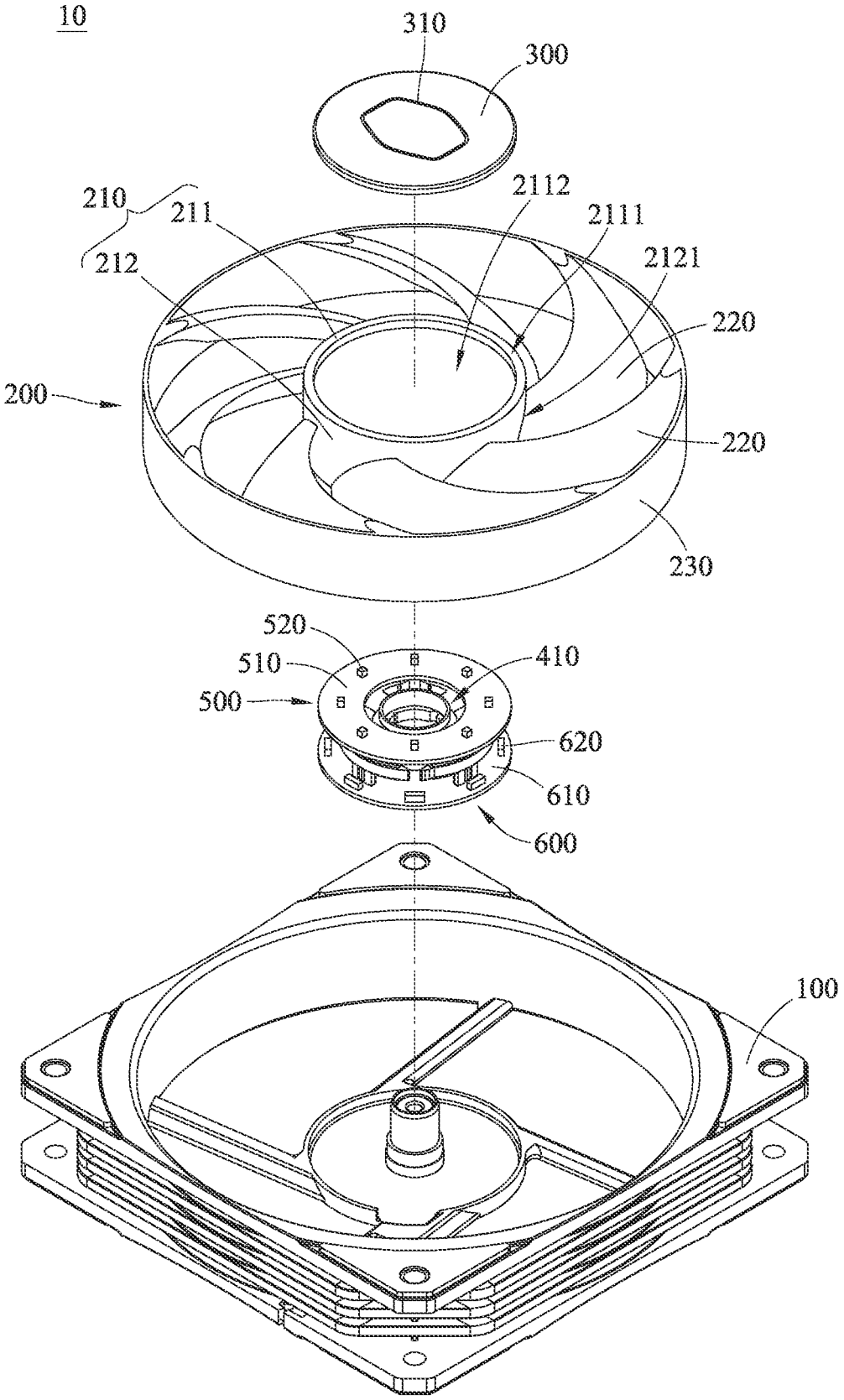
FIG. 2 is an exploded view of the light-emitting fan in FIG. 1.
Figure 3:
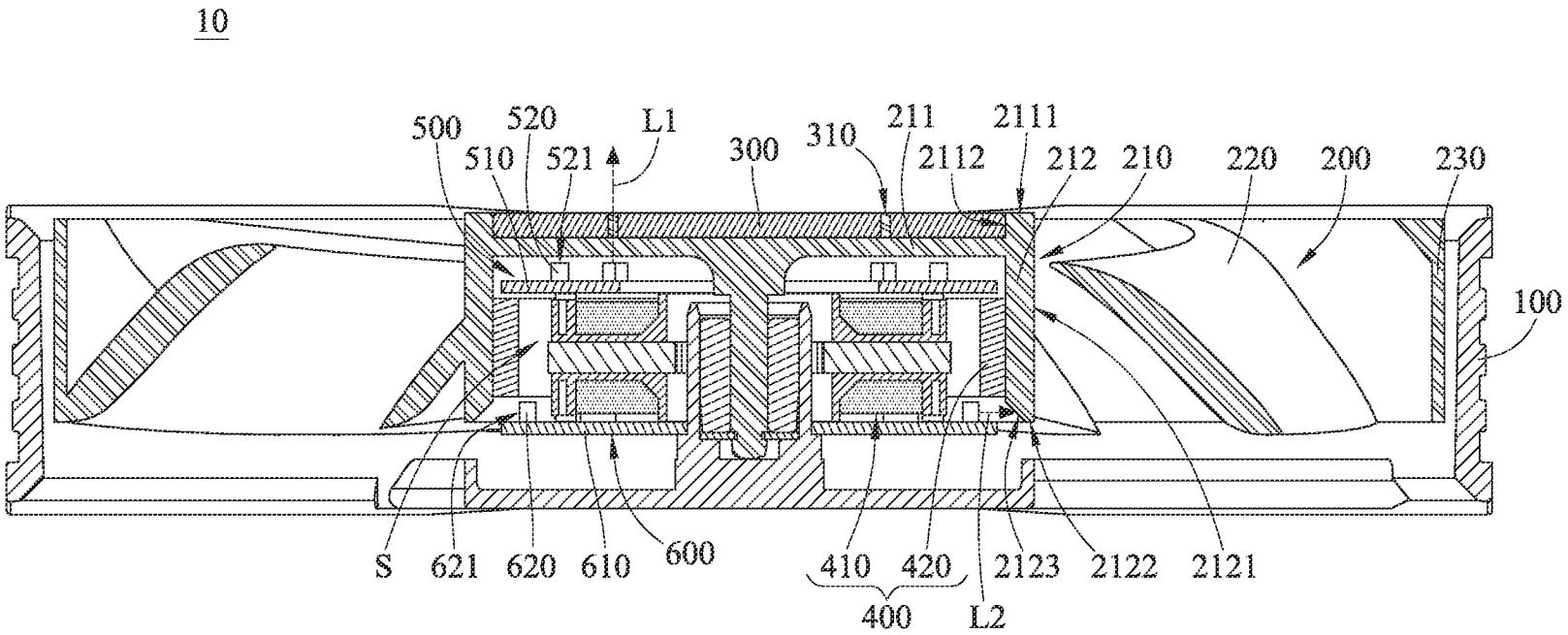
FIG. 3 is a cross-sectional view of the light-emitting fan in FIG. 1.

Refer to FIGS. 1 to 3, where FIG. 1 is a perspective view of a light-emitting fan 10 according to a first embodiment of the disclosure, FIG. 2 is an exploded view of the light-emitting fan 10 in FIG. 1, and FIG. 3 is a cross-sectional view of the light-emitting fan 10 in FIG. 1.

In this embodiment, the light-emitting fan 10 includes a fan frame 100, a light-permeable impeller 200, a decorative component 300, a driving assembly 400, a first light source assembly 500, and a second light source assembly 600.

The light-permeable impeller 200 is, for example, made of plastic material with high light permeability, such as PS, PMMA or PC. The light-permeable impeller 200 is rotatably mounted on the fan frame 100, such that the light-permeable impeller 200 is rotatable relative to the fan frame 100. The light-permeable impeller 200 includes a hub 210 and a plurality of blades 220. The hub 210 includes a top plate 211 and an annular side plate 212. The annular side plate 212 is connected to a periphery of the top plate 211, and the top plate 211 and the annular side plate 212 together form an accommodation space S. The top plate 211 of the hub 210 has an outer surface 2111 and a recess 2112. The outer surface 2111 faces away from the accommodation space S, and the recess 2112 is recessed from the outer surface 2111. The annular side plate 212 has an annular side surface 2121, a back surface 2122, and an inclined incident surface 2123. The annular side surface 2121 faces away from the accommodation space S. The back surface 2122 faces away from the top plate 211. The inclined incident surface 2123 is connected to the back surface 2122. The inclined incident surface 2123 faces away from the annular side surface 2121 and is non-parallel to the annular side surface 2121. The blades 220 are connected to the annular side surface 2121 of the hub 210.

In this embodiment, the inclined incident surface 2123 is at an angle to the annular side surface 2121, and the angle is, for example, 45 degrees, but the disclosure is not limited thereto; in some other embodiments, the angle between the inclined incident surface and the annular side surface may be any value between 0 degree and 90 degrees.

In this embodiment, the light-permeable impeller 200 may further include a silencer ring 230. The silencer ring 230 is connected to one end of each of the blades 220 located opposite to the hub 210 to reduce noise generated by the light-permeable impeller 200 during operation.

The decorative component 300 is located in the recess 2112 and has a light-permeable pattern structure 310. Specifically, the decorative component 300 is, for example, made of a light-permeable material or light guide material. Light-impermeable coating may be formed on a part of a surface of the decorative component 300, such that the other part of the surface of the decorative component 300 without the light-impermeable coating forms the light-permeable pattern structure 310. The light-permeable pattern structure 310 is, for example, in a hexagon shape.

The driving assembly 400 includes a stator 410 and a rotor 420. The stator 410 is, for example, an iron core with coils wrapped thereon. The stator 410 is fixed to the fan frame 100. The rotor 420 is fixed to the hub 210 of the light-permeable impeller 200. The stator 410 is configured to generate a magnetic field for driving the rotor 420 to rotate the light-permeable impeller 200.

The first light source assembly 500 is located in the accommodation space S and includes a first circuit board 510 and a plurality of vertical emission type light emitting diodes 520. The vertical emission type light emitting diodes 520 are disposed on the first circuit board 510, and a light-emitting surface 521 of each of the vertical emission type light emitting diodes 520 faces the top plate 211 of the hub 210. The first light source assembly 500 is configured to emit light L1 passing through the light-permeable pattern structure 310.

The second light source assembly 600 is located in the accommodation space S and includes a second circuit board 610 and a plurality of transverse emission type light emitting diodes 620. The transverse emission type light emitting diodes 620 are disposed on the second circuit board 610, and a light-emitting surface 621 of each of the transverse emission type light emitting diodes 620 faces the inclined incident surface 2123. The second light source assembly 600 is configured to emit light L2 to the inclined incident surface 2123. By doing so, a part of light may enter into the annular side plate 212 of the hub 210 and be guided to the blade 220, and another part of light may directly pass through the annular side plate 212 of the hub 210 so as to project on the blades 220.

Figure 4:
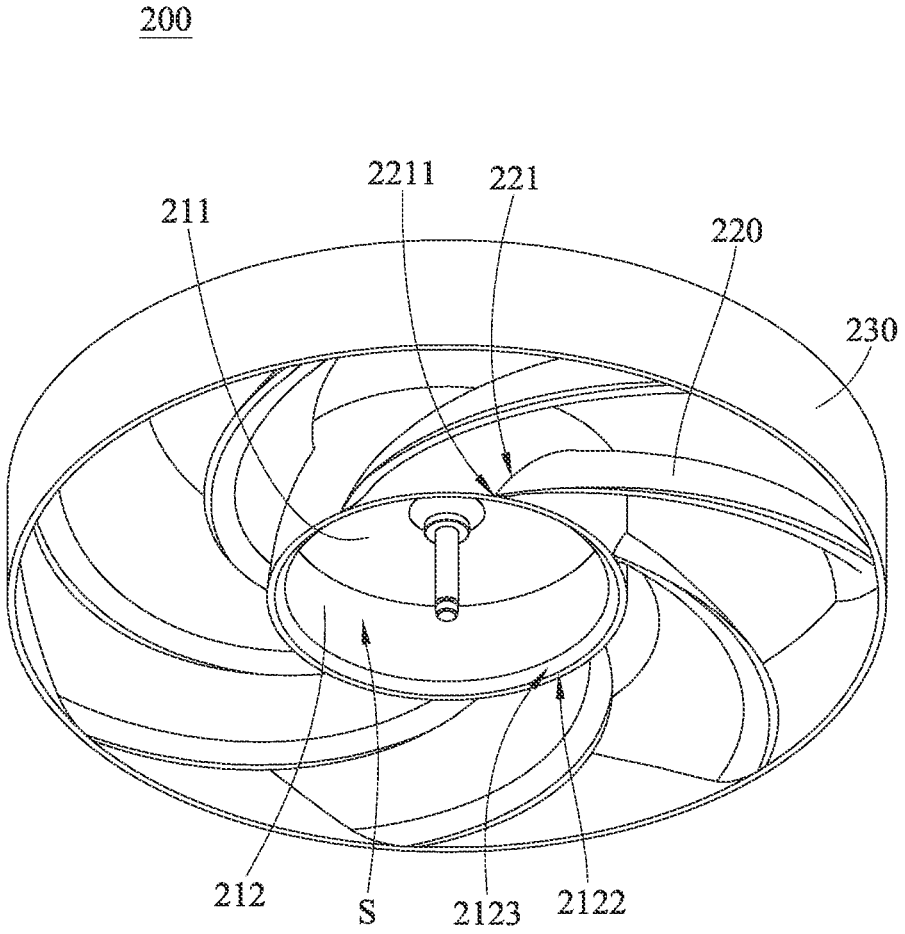
FIG. 4 is a perspective view of a light-permeable impeller in FIG. 2.

Referring to FIG. 4, FIG. 4 is a perspective view of the light-permeable impeller 200 in FIG. 2. In this embodiment, each of the blades 220 has a connection end 221. The connection ends 221 of the blades 220 are connected to the annular side surface 2121 of the hub 210. One edge 2211 of the connection end 221 is connected to the back surface 2122 of the annular side plate 212; that is, when the light-emitting fan 10 is placed on a horizontal surface, and the decorative component 300 is located opposite to the horizontal surface, the edge 2211 (e.g., lower edge) of the connection end 221 of each blade 220 and the back surface 2122 of the annular side plate 212 have the same height relative to the horizontal surface.

Figure 5:
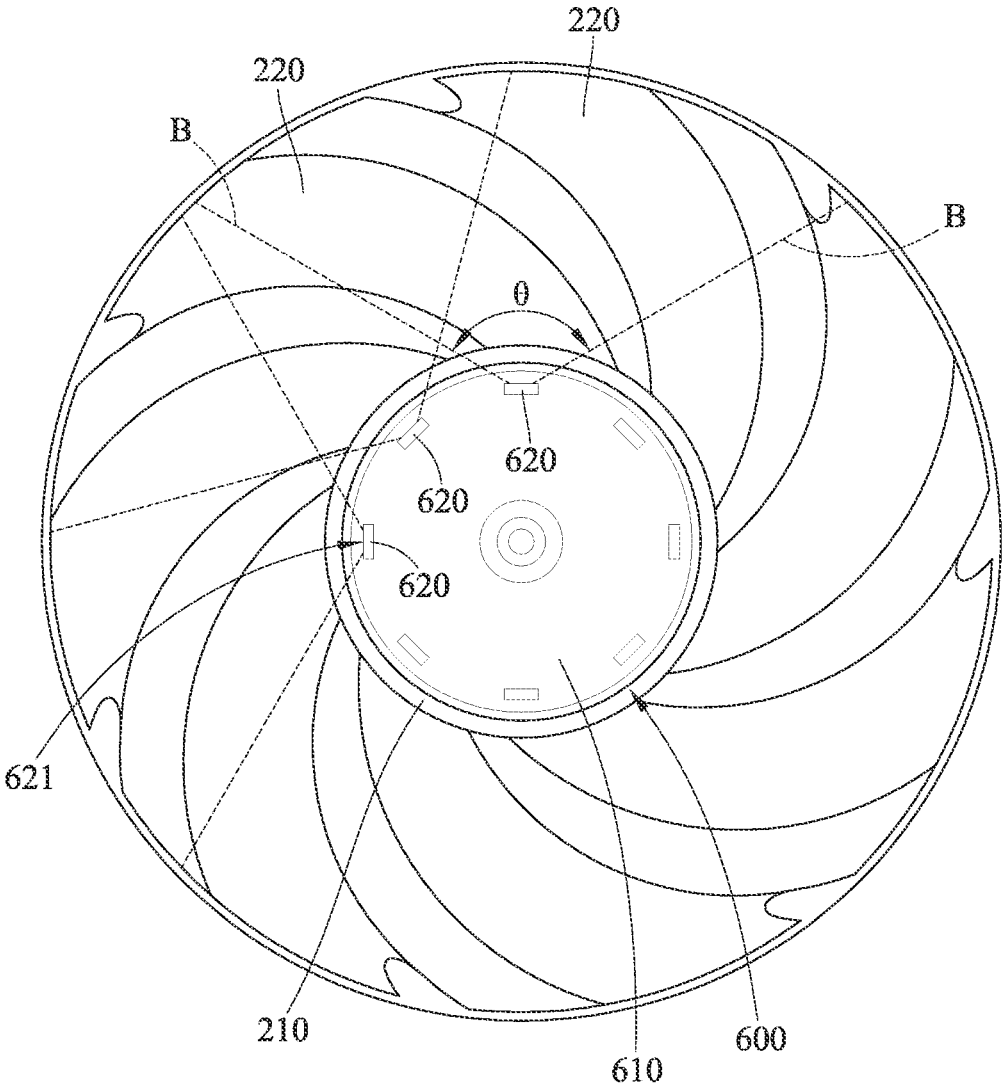
FIG. 5 is a schematic view of the light-permeable impeller and a second light source assembly in FIG. 2.

Referring to FIG. 5, FIG. 5 is a schematic view of the light-permeable impeller 200 and the second light source assembly 600 in FIG. 2. In this embodiment, a beam angle θ of each of the transverse emission type light emitting diode 620 is, for example, about 120 degrees; that is, light emitted by each transverse emission type light emitting diode 620 is in the area defined by two boundaries B, and an angle between the two boundaries B is about 120 degrees. Note that the value of the beam angle θ of each of the transverse emission type light emitting diode 620 is not restricted and may be any value within a range from 1 degree to 360 degrees in some other embodiments.

Since the light-emitting fan 10 is equipped with the first light source assembly 500 and the second light source assembly 600, the first light source assembly 500 can uniformly illuminate the hub 210 of the light-permeable impeller 200, and the second light source assembly 600 can uniformly illuminate the blades 220 of the light-permeable impeller 200, such that the luminous quality of the light-emitting fan 10 is increased. In addition, the light-emitting frequencies of the first light source assembly 500 and the second light source assembly 600 may be determined according to the rotation frequency of the light-emitting fan 10 so as to achieve a special visual effect via persistence of vision.

Figure 6:
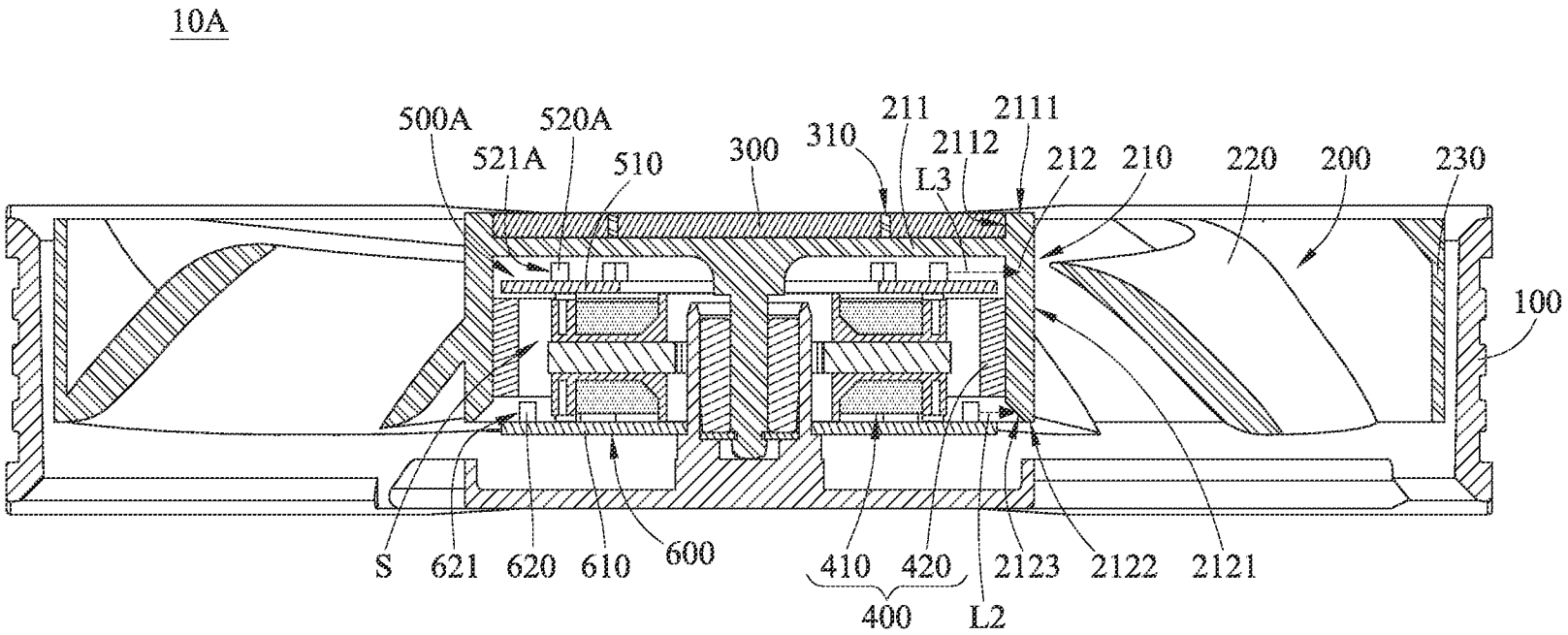
FIG. 6 is a cross-sectional view of a light-emitting fan according to a second embodiment of the disclosure.

In the aforementioned embodiment, the first light source assembly 500 includes the vertical emission type light emitting diodes 520, but the disclosure is not limited thereto. Referring to FIG. 6, FIG. 6 is a cross-sectional view of a light-emitting fan 10A according to a second embodiment of the disclosure. The light-emitting fan 10A of this embodiment is similar to the light-emitting fan 10 of the previous embodiment, and the same reference numeral of the components in this and previous embodiment represents that the components in this and previous embodiments have the same structure and the same connection relationship with other components, and thus the following descriptions mainly introduce the difference between this and previous embodiments. In this embodiment, a first light source assembly 500A is located in the accommodation space S and includes a first circuit board 510 and a plurality of transverse emission type light emitting diodes 520A. The transverse emission type light emitting diodes 520A are disposed on the first circuit board 510, and a light-emitting surface 521A of each of the transverse emission type light emitting diodes 520A faces the annular side plate 212 of the hub 210. The first light source assembly 500A is configured to emit light L3 to the annular side plate 212, and the light L3 can be guided to the light-permeable pattern structure 310 so as to pass through the light-permeable pattern structure 310.

According to the light-emitting fans as discussed in the above embodiments, since the light-emitting fan is equipped with the first light source assembly and the second light source assembly, the first light source assembly can uniformly illuminate the hub of the light-permeable impeller, and the second light source assembly can uniformly illuminate the blades of the light-permeable impeller, such that the luminous quality of the light-emitting fan is increased. In addition, the light-emitting frequencies of the first light source assembly and the second light source assembly may be determined according to the rotation frequency of the light-emitting fan so as to achieve a special visual effect via persistence of vision.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A light-emitting fan, comprising:

a fan frame;

a light-permeable impeller, wherein the light-permeable impeller is rotatably mounted on the fan frame, the light-permeable impeller comprises a hub and a plurality of blades, the hub comprises a top plate and an annular side plate, the annular side plate is connected to a periphery of the top plate, the top plate and the annular side plate together form an accommodation space, the annular side plate has an annular side surface and an inclined incident surface, the annular side surface faces away from the accommodation space, the inclined incident surface faces away from the annular side surface and is non-parallel to the annular side surface, and the plurality of blades are connected to the annular side surface of the hub;

a first light source assembly, located in the accommodation space and configured to emit light to the top plate; and a second light source assembly, located in the accommodation space and configured to emit light to the inclined incident surface.

2. The light-emitting fan according to claim 1, wherein the annular side plate further has a back surface, the back surface faces away from the top plate, and the inclined incident surface is connected to the back surface.

3. The light-emitting fan according to claim 2, wherein each of the plurality of blades has a connection end connected to the annular side surface of the hub, and one edge of the connection end of each of the plurality of blades is connected to the back surface of the annular side plate.

4. The light-emitting fan according to claim 1, wherein the first light source assembly comprises a first circuit board and a plurality of vertical emission type light emitting diodes, the plurality of vertical emission type light emitting diodes are disposed on the first circuit board, and a light-emitting surface of each of the plurality of vertical emission type light emitting diodes faces the top plate of the hub.

5. The light-emitting fan according to claim 1, wherein the first light source assembly comprises a first circuit board and a plurality of transverse emission type light emitting diodes, the plurality of transverse emission type light emitting diodes are disposed on the first circuit board, and a light-emitting surface of each of the plurality of transverse emission type light emitting diodes faces the annular side plate of the hub.

6. The light-emitting fan according to claim 4, wherein the second light source assembly comprises a second circuit board and a plurality of transverse emission type light emitting diodes, the plurality of transverse emission type light emitting diodes are disposed on the second circuit board, and a light-emitting surface of each of the plurality of transverse emission type light emitting diodes faces the inclined incident surface.

7. The light-emitting fan according to claim 6, wherein a beam angle of each of the plurality of transverse emission type light emitting diodes falls within a range from 1 degree to 360 degrees.

8. The light-emitting fan according to claim 1, further comprising a decorative component, wherein the top plate of the hub has an outer surface and a recess, the recess is recessed from the outer surface, the decorative component is located in the recess, the decorative component has a light-permeable pattern structure, and the first light source assembly is configured to emit light passing through the light-permeable pattern structure.

9. The light-emitting fan according to claim 1, wherein the light-permeable impeller further comprises a silencer ring, and the silencer ring is connected to one end of each of the plurality of blades located opposite to the hub.

10. The light-emitting fan according to claim 1, further comprising a driving assembly, wherein the driving assembly comprises a stator and a rotor, the stator is fixed to the fan frame, the rotor is fixed to the hub of the light-permeable impeller, and the rotor is configured to drive the light-permeable impeller to rotate relative to the fan frame.

11. The light-emitting fan according to claim 1, wherein the inclined incident surface is at an angle to the annular side surface, and the angle falls within a range between 0 degree to 90 degrees.

* * * * *